US007275650B1

(12) United States Patent
Fangman et al.

(10) Patent No.: US 7,275,650 B1
(45) Date of Patent: Oct. 2, 2007

(54) METHOD AND APPARATUS FOR STORING GREASE

(75) Inventors: Lester J. Fangman, Seneca, KS (US); Dale A. Sudbeck, Baileyville, KS (US); Scott A. Sargent, Des Moines, IA (US); Tim R. Phillips, Altoona, IA (US); J. Todd Ferrell, Clive, IA (US)

(73) Assignee: Darling National LLC, Irving, TX (US)

( * ) Notice: Subject to any disclaimer, the term of this patent is extended or adjusted under 35 U.S.C. 154(b) by 502 days.

(21) Appl. No.: 10/628,003

(22) Filed: Jul. 25, 2003

(51) Int. Cl.

| | |
|---|---|
| ***B65D 21/02*** | (2006.01) |
| ***B65D 51/18*** | (2006.01) |
| ***B65D 43/14*** | (2006.01) |
| ***F17C 13/08*** | (2006.01) |
| *F17C 3/00* | (2006.01) |

(52) U.S. Cl. ..... 220/23.83; 220/23.87; 220/23.89; 220/254.2; 220/254.6; 220/259.2; 220/560.03

(58) Field of Classification Search ..... 220/560.03, 220/826, 819, 23.83, 23.87, 23.89, 254.2, 220/254.6, 259.2
See application file for complete search history.

(56) References Cited

U.S. PATENT DOCUMENTS

| | | | | |
|---|---|---|---|---|
| 3,009,591 | A * | 11/1961 | Jones | 414/424 |
| 3,365,092 | A * | 1/1968 | Blessing | 220/23.88 |
| 4,685,567 | A * | 8/1987 | Webb | 206/506 |
| 4,804,113 | A * | 2/1989 | Ciaccio | 222/142.1 |
| 5,111,958 | A * | 5/1992 | Witthoeft | 220/524 |
| 5,330,069 | A * | 7/1994 | Jamison et al. | 220/819 |
| 5,454,478 | A * | 10/1995 | Everson | 220/23.83 |
| 5,888,043 | A * | 3/1999 | Jatcko | 414/459 |
| 5,979,725 | A * | 11/1999 | Lehrman | 224/539 |
| 6,000,576 | A * | 12/1999 | Liu | 220/826 |
| 6,193,097 | B1 * | 2/2001 | Martin Perianes | 220/592.03 |
| 6,354,782 | B1 * | 3/2002 | Barry | 414/392 |
| 6,533,122 | B1 * | 3/2003 | Plunkett | 206/600 |
| 6,581,796 | B1 * | 6/2003 | Pilkinton | 220/495.04 |
| 6,588,817 | B1 * | 7/2003 | Wadeyka et al. | 294/147 |
| 6,616,400 | B1 * | 9/2003 | Caponey | 414/809 |
| 6,666,333 | B2 * | 12/2003 | Auclair | 206/521 |
| 6,715,627 | B1 * | 4/2004 | Bonner et al. | 220/4.27 |
| 6,729,754 | B1 * | 5/2004 | Midas | 366/208 |
| 6,808,081 | B1 * | 10/2004 | Citro | 220/772 |
| 6,926,137 | B2 * | 8/2005 | Rudnick et al. | 206/15.3 |
| 6,929,142 | B2 * | 8/2005 | Gilbert et al. | 220/216 |
| 7,000,796 | B2 * | 2/2006 | Goritzka et al. | 220/263 |
| 7,201,383 | B2 * | 4/2007 | Gibby | 280/47.26 |

* cited by examiner

*Primary Examiner*—Anthony D. Stashick
*Assistant Examiner*—Niki M. Eloshway
(74) *Attorney, Agent, or Firm*—McKee, Voorhees & Sease, P.L.C.

(57) ABSTRACT

A double walled container is provided by an inner container that is fitted within an outer container. End flaps are provided on the outer container for engaging the inner container and closing the gap between the inner container and the outer container. The method involves lifting the inner container out of the outer container, removing the grease from the inner container, and inserting the outer container back into the inner container.

4 Claims, 3 Drawing Sheets

METHOD AND APPARATUS FOR STORING GREASE

BACKGROUND OF THE INVENTION

The present invention relates to a method and apparatus for storing grease.

Currently grease is stored at various establishments in a single-walled container. Periodically a truck comes to the container, lifts it by chains, and dumps the contents into a large container in the truck. On some occasions, particularly in winter, the container is first dipped in hot water to loosen the grease from the side walls of the container before dumping it into the larger container of the truck.

Single walled containers are susceptible to developing leaks at the site where the containers are stored. Therefore it is desirable to provide a double-walled container.

Double-walled containers have been provided, but such containers require the replacement of the single wall containers. It is desirable to provide an outer container which can be combined with an inner container so that the present single-walled containers can be used.

Therefore, a primary object of the present invention is the provision of a method and apparatus for storing grease.

A further object of the present invention is the provision of a method and apparatus for storing grease which utilizes a double wall construction so as to minimize the spillage of grease at the site where the container is located.

A further object of the present invention is the provision of a method and apparatus for storing grease which utilizes an outer container that can be combined with present single wall containers to provide a double wall container.

A further object of the present invention is the provision of a method and apparatus for storing grease which is economical to manufacture, durable in use, and efficient in operation.

BRIEF SUMMARY OF THE INVENTION

The foregoing objects may be achieved by an outer container for receiving an inner container having first and second opposite inner container end walls, each of which comprises a lower pin and an upper pin extending outwardly. The outer container comprises a container box comprising first and second outer container end walls, a front outer container wall, a rear out container wall, and an outer container floor enclosing an outer container chamber having an open upper end. The outer container chamber is of a size to permit the inner container to be inserted therein through the open upper end. First and second flaps are hinged to the first and second outer container end walls respectively adjacent the open upper end for pivotal movement about first and second horizontal axis respectively. The flaps pivot from an open position wherein the first and second flaps are free from covering relation over the open upper end of the outer container box to a closed position wherein the first and second flaps each partially cover the open upper end of the outer container box.

According to another feature of the present invention a notch is formed in each of the first and second flaps. Notch covers pivotally mounted to the first and second flaps are pivotal from an uncovered position free from covering relation over the first and second notches respectively to a covered position in covering relation over the first and second notches respectively.

According to another feature of the invention a plurality of guide cams are positioned within the open upper end of the container box for engaging and guiding the inner container into the container chamber through the open upper end thereof.

According to another feature of the present invention a double wall container can be formed by combining the outer container having an outer container chamber with an inner container that is fitted within the outer container chamber. The result is that the inner container is positioned within the outer container chamber and includes first and second inner side walls facing first and second outer side walls, first and second inner end walls facing first and second outer end walls, and an inner bottom wall facing the outer bottom wall. The inner container has an inner container chamber for holding grease. Attachment members are connected to the inner container and a power lifter detachably connects to the attachment members for lifting the inner container out of the container chamber through the open upper end thereof.

The method of the present invention comprises taking the outer container and the inner container and positioning the inner container in registered alignment above the open upper end of the outer container. The inner container is then lowered into the outer container chamber through the open upper end thereof so that the first and second inner side walls face the first and second outer side walls, the first and second inner end walls face the first and second outer end walls, and the inner bottom wall faces the outer bottom wall. Grease is stored within the inner container chamber.

DETAILED DESCRIPTION OF THE PREFERRED EMBODIMENT

Figure 2:
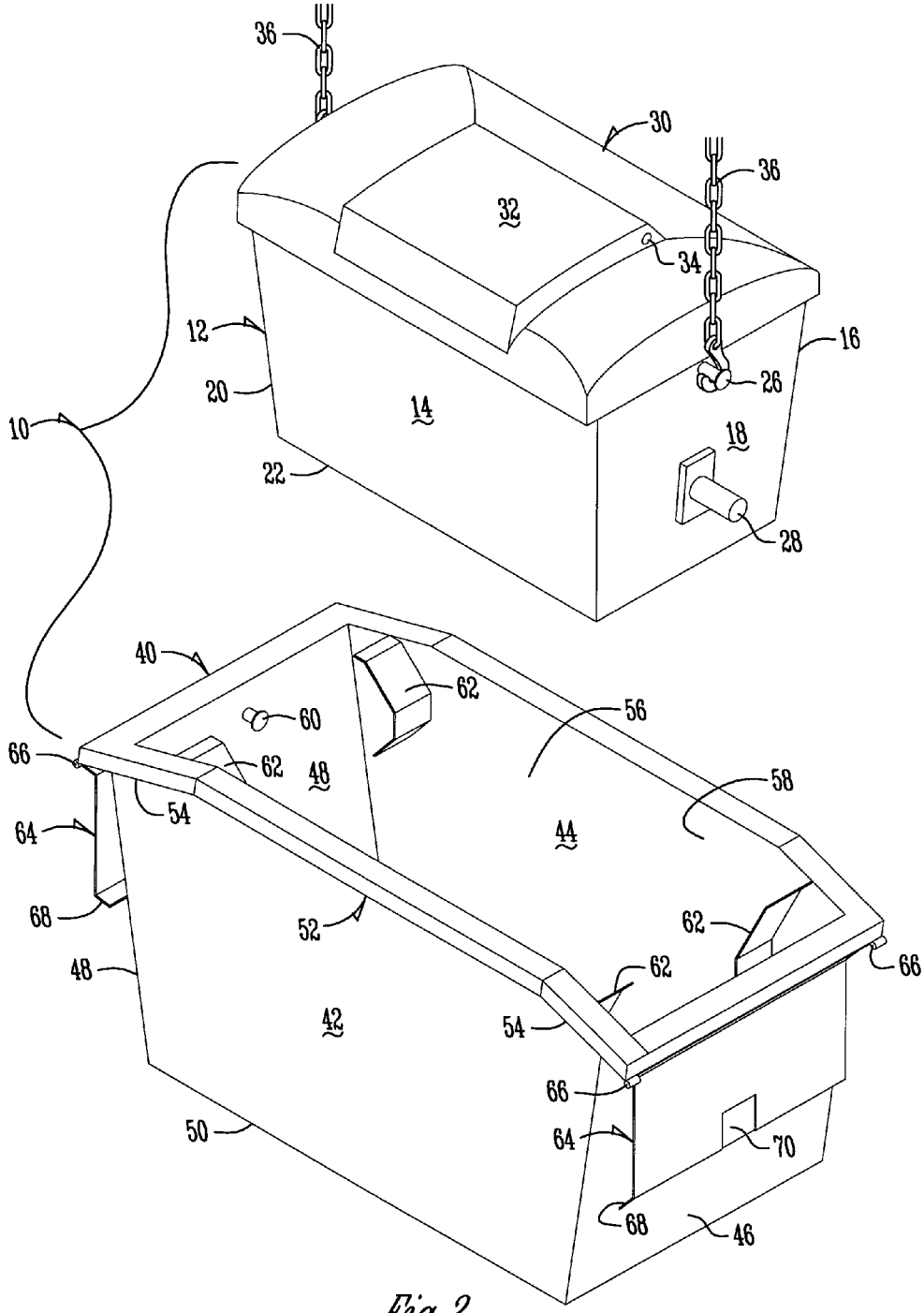
FIG. 2 is an exploded perspective view showing the lifting of the inner container out of the outer container.

Referring to the drawings, a double walled container 10 includes an inner container 12. The inner container 12 includes an inner front wall 14, an inner rear wall 16, an inner end wall 18, another inner end wall 20, and an inner bottom wall 22. An inner top frame 24 extends around the upper perimeter of walls 14-20. A pair of lift pins 26 extend outwardly from the top frame 24 adjacent the top of the inner container 12. These lift pins enable a pair of chains 36 having hooks on the bottom thereof to be hooked around the lift pins 26 for lifting the inner container 12 upwardly as shown in FIG. 2. Normally these lift chains 36 are mounted on the spaced apart booms of a truck.

A pair of pivot pins 28 extend from the opposite end walls 18, 20 below the lift pins 26. Pivot pins 28 are used for dumping the contents of the inner container 12 into a larger container within the truck. The pivot pins 28 are placed upon pivot rests (not shown) and the chains 36 are lowered, resulting in the inner container 12 tilting about the axis provided by pins 28 so as to remove the contents of the inner container 12 and dump them into the larger container within the truck.

Figure 3:
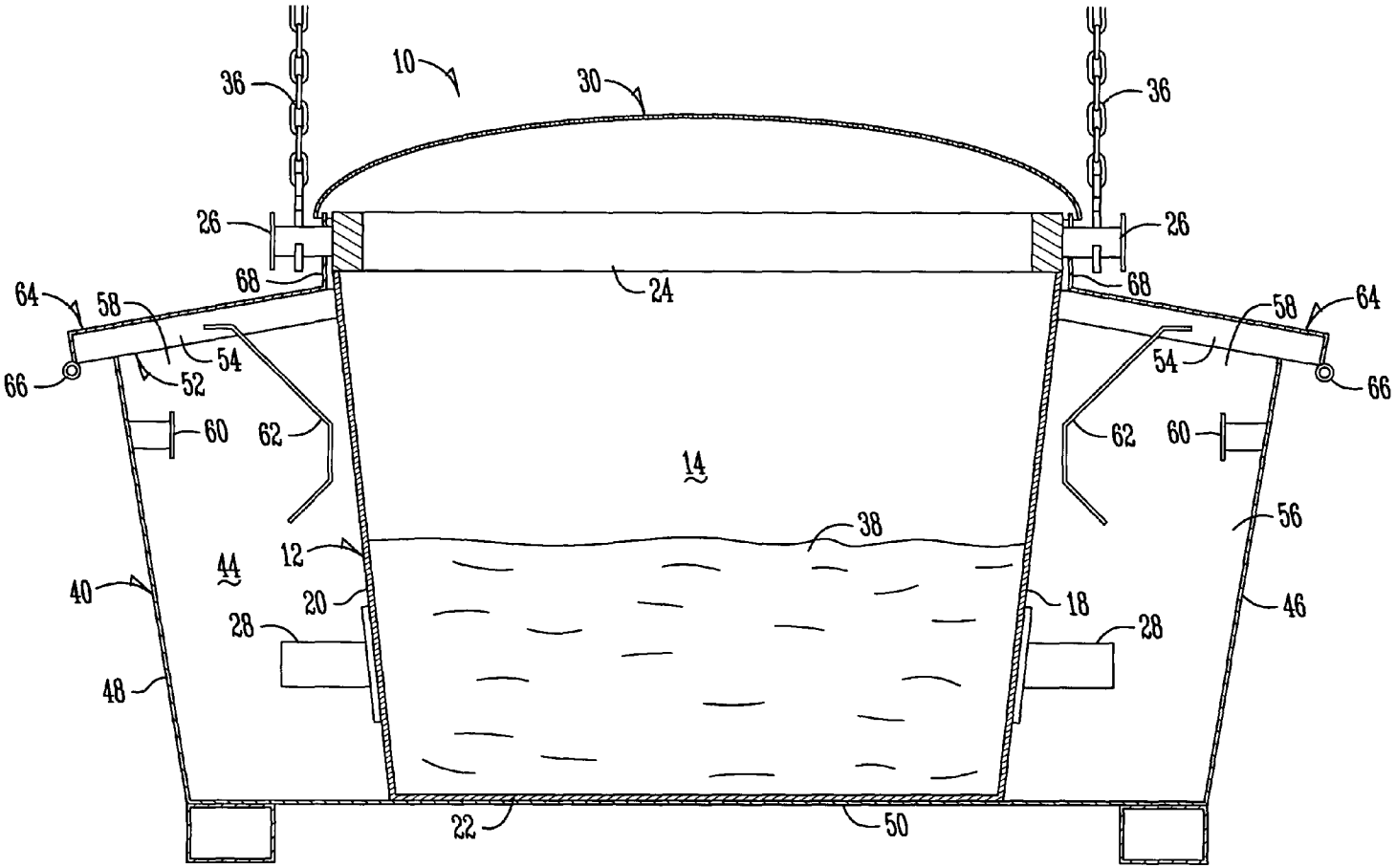
FIG. 3 is a sectional view taken along line 3-3 of FIG. 1.

A lid 30 includes a hinged door 32 therein which can be pivoted about hinge 34 for access to the interior of the inner container 12. The lid 30 is removable during the operation for tilting and emptying the inner container 12. As seen in FIG. 3, the inner container 12 is adapted to provide a quantity of grease or oil 38 coming from restaurants or other sources.

An outer container 40 includes an outer front wall 42, an outer rear wall 44, an outer end wall 46, another outer end wall 48, and a bottom wall 50. Extending around the upper edges of walls 42, 44, 46 and 48 is an outer top frame 52. Top frame 52 includes slanted frame ends 54. The outer container 40 includes a cavity or outer container chamber 56 having an open upper end 58. On the inside surfaces of the end walls 46, 48 are a pair of outer lift pins 60 which enable the outer container 40 to be lifted and moved to the desired location. Chains 36 can be used for this purpose.

Inside the outer container chamber 56 are four cam plates 62 which are located adjacent the four corners of the outer container chamber 56. These cam plates are welded to the side walls 42, 44, and help to guide the inner container 12 as it is lowered into the outer container chamber 56 from the position shown in FIG. 2 to the position shown in FIGS. 1 and 3. This results in centering of the inner container 12 with respect to the end walls 46, 48, and also with respect to the front and rear walls 42, 44.

Figure 1:
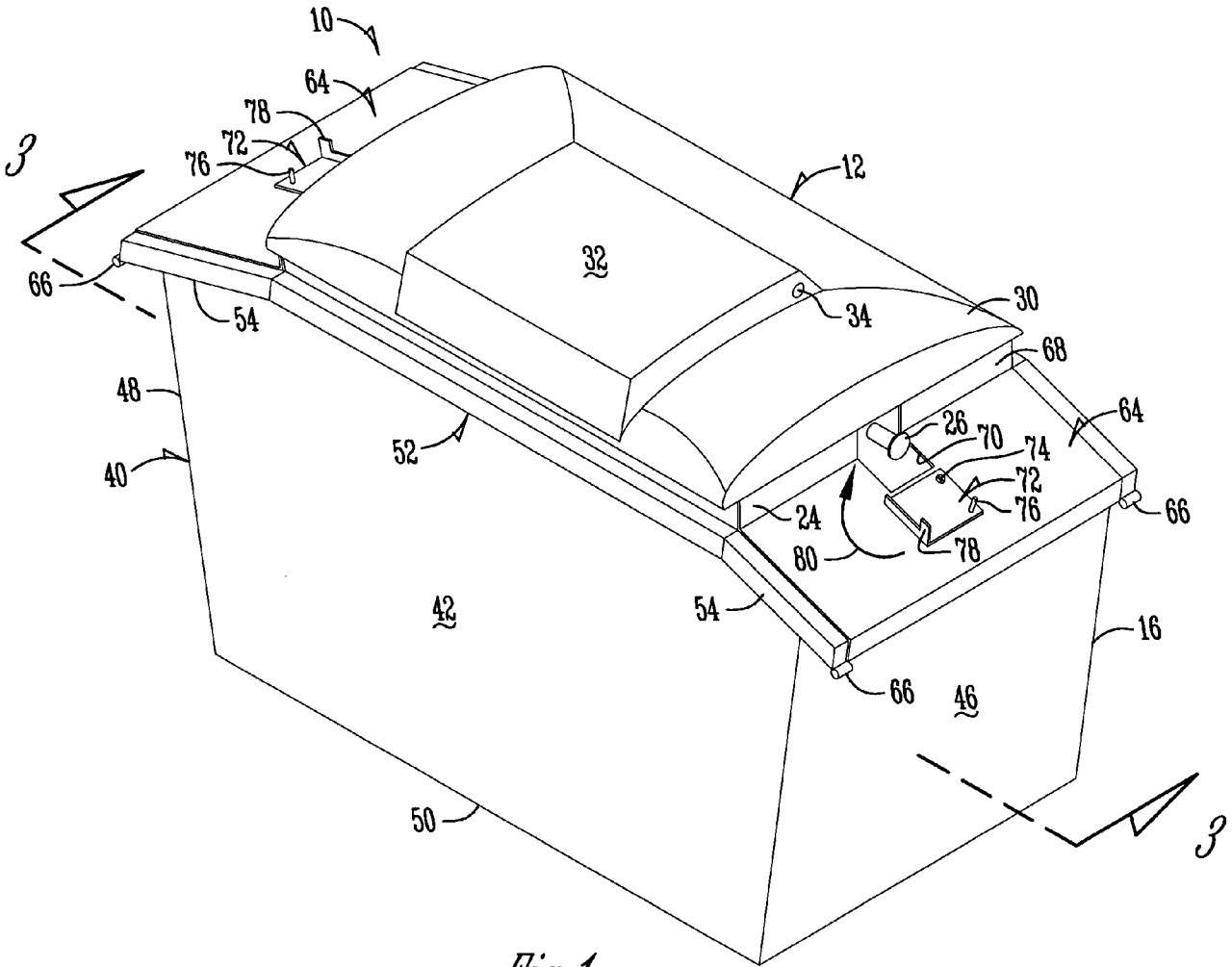
FIG. 1 is a perspective view of the combined outer and inner containers providing a double walled container.

A pair of end flaps 64 are pivotally mounted to the slanted frame ends 54 of the outer top frame 52 by means of hinges 66. The hinges 66 provide pivotal movement of the flaps 64 about horizontal axes which extend perpendicular to the longitudinal axis of the outer container 40. At the outer edge of each flap 64 is a cover flange 68. A cut out notch 70 is provided in the end flaps 64 in a central location and also is provided in the cover flanges 68. Each end flap 64 includes a notch cover 72 which is mounted for pivotal movement about a notch cover hinge 74. A notch cover handle 76 is used for pivoting the notch cover 72 about the hinge 74 from the position shown in FIG. 1 to the position shown in FIG. 3. Each flap 64 includes a notch cover flange 78 which is pivotal to cover the space around lift pin 26 as shown in FIG. 1. The end flap 64 pivots approximately 270° from the position shown in FIG. 1 in the direction of arrow 80 so that the notch cover flange 78 is positioned around the lift pin 26 and the cover plate or flap 64 is in covering relation over the cut out notch 70. Also as can be seen in FIG. 3 the cover flange 68 fits under the outer edges of the lid 30 so as to prevent water from entering the interior of the inner container 12 and also so as to prevent grease from splashing out of the inner container 12.

It can be seen that the combination of the inner container 12 and the outer container 40 provides a double wall container when they are placed in combination as shown in FIG. 3. The end flaps 64 pivot into partial covering relation over the upper end 58 of the outer container chamber 56 so as to provide a double wall construction which minimizes the chances that the grease 38 will spill.

When it is desired to empty the inner container 10, the truck is driven adjacent the double wall container 10 and the lift chains 36 are attached by hooks to the lift pins 26. The lid 30 is removed.

Then the inner container 12 is lifted upwardly out of the outer container 40 as shown in FIG. 2. The truck can then submerge the inner container 12 in hot water if the contents are frozen so as to loosen the contents. Then the truck places the pivot pins 28 on pivot pin support and lowers the chains 36 so as to cause the inner container 12 to tilt and empty its contents into a larger container within the truck.

After emptying the contents of the inner container 12, the lift chains are then lifted up again and the inner container is lowered into the outer container chamber 56. The cams 62 help center the inner container as it is lowered. The hinge pins 28 pass between the cams 62. Then the flaps 64 are folded from their positions shown in FIG. 2 to their position shown in FIG. 3 and the lid 30 is positioned in covering relation over the cover flanges 68 as shown in FIG. 3 and results in a double wall container again which can be used to store grease and to minimize the chances of spillage.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. A double wall grease container assembly comprising:

an outer container having first and second outer side walls, first and second outer end walls, and a bottom outer wall forming an outer container chamber having an open upper end;

an inner grease container fitted within the outer container chamber and having first and second inner side walls facing the first and second outer side walls, first and second inner end walls facing the first and second outer end walls, and an inner bottom wall facing the outer bottom wall, the inner container having an inner grease container chamber for holding grease;

a first flap and a second flap pivotally mounted to the outer container for pivotal movement about first and second flap axes respectively from an open position out of covering relation over the open upper end of the outer container to a closed position in partial covering relation over the open upper end of the outer container;

the inner grease container not being covered by the flaps when the flaps are in the closed position;

attachment members connected to the inner grease container and positioned above the first and second flaps;

a power lifter detachably connected to the attachment members for lifting the inner grease container out of the outer container chamber through the open upper end thereof and for lowering the inner grease container into the outer container chamber through the open end thereof;

a lifting mechanism detachably secured to the attachment members for lifting the inner container out of the outer container chamber through the open upper end thereof and for lowering the inner container into the outer container chamber through the open upper end thereof;

first and second pivot pins projecting from the inner container, the first and second pivot pins being within the outer container chamber; and the first and second flaps including first and second notches therein respectively in registered alignment above the first and second pivot pins respectively.

2. The double wall container assembly according to claim 1 and further comprising first and second notch covers pivotally mounted to the first and second flaps respectively, the first and second notch covers being pivotal from a covered position in registered alignment above the first and second pivot pins respectively to an uncovered position free from covering relation over the first and second pivot pins.

3. A double wall grease container assembly comprising:

an outer container having first and second outer side walls, first and second outer end walls, and a bottom outer wall forming an outer container chamber having an open upper end;

an inner grease container fitted within the outer container chamber and having first and second inner side walls facing the first and second outer side walls, first and second inner end walls facing the first and second outer end walls, and an inner bottom wall facing the outer bottom wall, the inner container having an inner grease container chamber for holding grease;

a first flap and a second flap pivotally mounted to the outer container for pivotal movement about first and second flap axes respectively from an open position out of covering relation over the open upper end of the outer container to a closed position in partial covering relation over the open upper end of the outer container;

attachment members connected to the inner grease container and positioned above the first and second flaps;

a power lifter detachably connected to the attachment members for lifting the inner grease container out of the outer container chamber through the open upper end thereof and for lowering the inner grease container into the outer container chamber through the open end thereof;

a lifting mechanism detachably secured to the attachment members for lifting the inner container out of the outer container chamber through the open upper end thereof and for lowering the inner container into the outer container chamber through the open upper end thereof;

first and second pivot pins projecting from the inner container, the first and second pivot pins being within the outer container chamber; and the first and second flaps including first and second notches therein respectively in registered alignment above the first and second pivot pins respectively.

4. The double wall container assembly according to claim 3 and further comprising first and second notch covers pivotally mounted to the first and second flaps respectively, the first and second notch covers being pivotal from a covered position in registered alignment above the first and second pivot pins respectively to an uncovered position free from covering relation over the first and second pivot pins.

* * * * *